US005400633A

United States Patent [19]

Segal et al.

[11] Patent Number: 5,400,633

[45] Date of Patent: Mar. 28, 1995

[54] APPARATUS AND METHOD FOR DEFORMATION PROCESSING OF METALS, CERAMICS, PLASTICS AND OTHER MATERIALS

[75] Inventors: Vladimir Segal, Bryan; Ramon E. Goforth; K. Ted Hartwig, both of College Station, all of Tex.

[73] Assignee: The Texas A&M University System, College Station, Tex.

[21] Appl. No.: 116,721

[22] Filed: Sep. 3, 1993

[51] Int. Cl.[6] ..... B21C 27/00

[52] U.S. Cl. ..... 72/272; 72/253.1

[58] Field of Search ..... 72/253.1, 257, 260, 72/271, 272

[56] References Cited

U.S. PATENT DOCUMENTS

| | | | |
|---|---|---|---|
| 3,107,787 | 10/1963 | Scribner | 72/272 |
| 3,161,756 | 12/1964 | Haverkamp et al. | 72/253.1 |
| 3,871,200 | 3/1975 | Onoda et al. | 72/271 |
| 3,922,898 | 12/1975 | Voorhes | 72/270 |

FOREIGN PATENT DOCUMENTS

| | | | |
|---|---|---|---|
| 254313 | 11/1991 | Japan | 72/253.1 |
| 492780 | 2/1976 | U.S.S.R. . | |
| 515968 | 5/1976 | U.S.S.R. . | |
| 1140870 | 2/1985 | U.S.S.R. . | |

OTHER PUBLICATIONS

Vladimir M. Segal, "Working of Metals by Simple Shear Deformation Process," Interstate Forging Industries, Inc., Presentation in Chicago, Spring of 1992, pp. 403–406.

Vladimir M. Segal, "The Special Metalworking Process for Advanced Materials Technology," Scottsdale, 1992, pp. 1–5.

*Primary Examiner*—Lowell A. Larson

*Attorney, Agent, or Firm*—Baker & Botts

[57] ABSTRACT

Unique methods and apparatus are provided for deformation processing of advanced materials using this invention. Enhanced physico-mechanical properties are obtained by extrusion through a die assembly with two channels having equal cross sectional areas under near frictionless conditions. Also, large work pieces of advanced material can be intensively deformed by simple shear forces in a selected manner to produce the specific desired material characteristics. The results of applying the process to the working of cast metals, structure refinement and ductilization of brittle materials, structure-and texture-formation of the special alloys, and compacting of powder briquettes produces enhanced material characteristics in the finished product.

29 Claims, 3 Drawing Sheets

FIG. 1
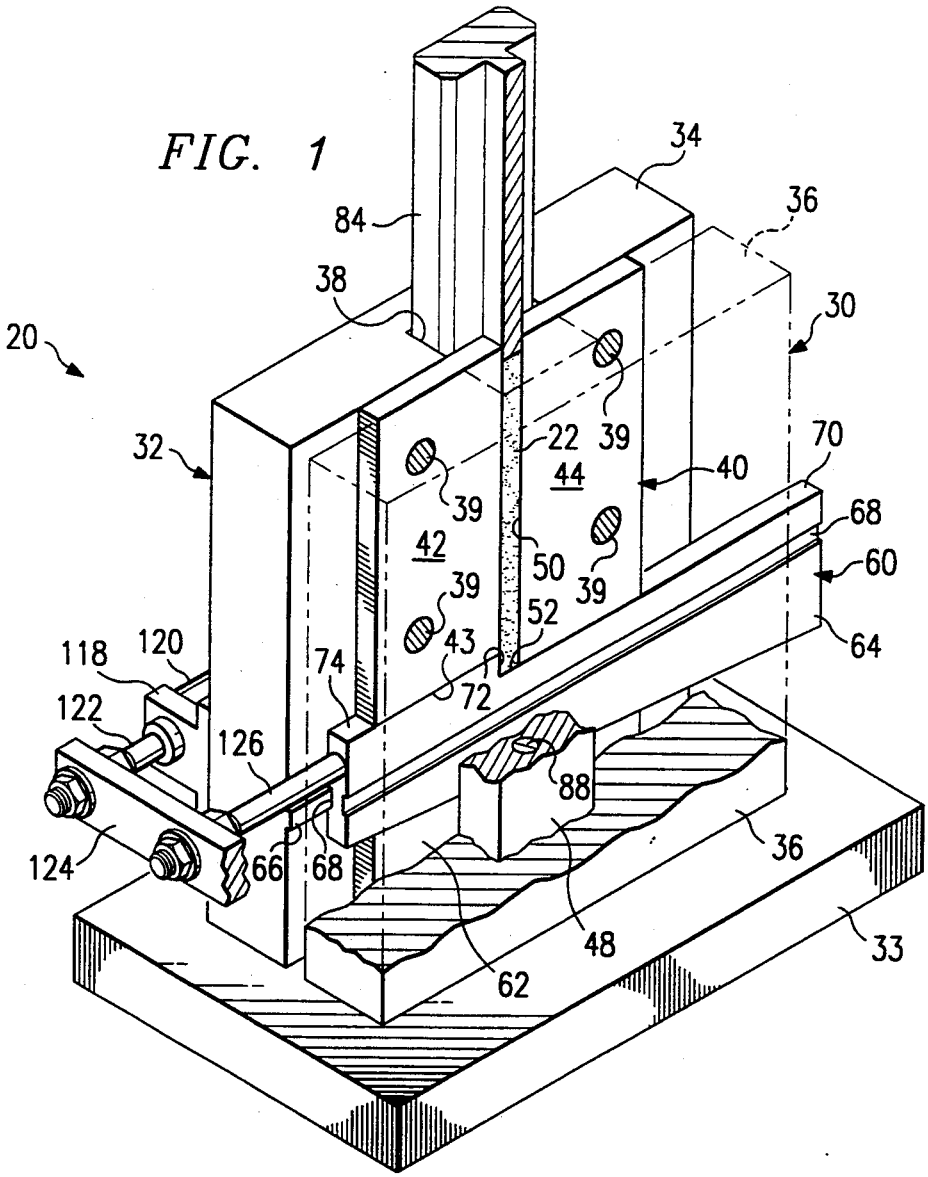
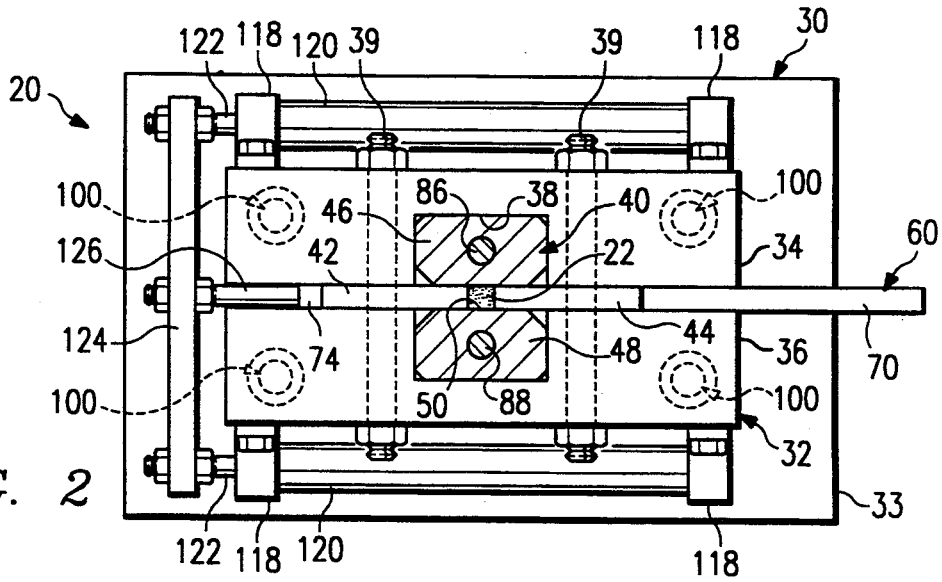
FIG. 2

APPARATUS AND METHOD FOR DEFORMATION PROCESSING OF METALS, CERAMICS, PLASTICS AND OTHER MATERIALS

TECHNICAL FIELD OF THE INVENTION

This invention relates to the field of deformation processing of selected materials to enhance the physico-mechanical properties of the materials by controlling the microstructure resulting from such deformation.

BACKGROUND OF THE INVENTION

For many years plastic deformation has been used to structurally alter and to enhance the physical properties of different materials. In particular, hot working is a universally accepted method for defect removal and achievement of high ductility and strength mechanical properties associated with cast ingots. Traditional metal forming processes such as forging, rolling and extrusion have also been used for defect removal and enhancement of mechanical properties of selected materials. These processes are often associated with multiple reductions of the original cross section of the selected materials. For example, to guarantee high quality products from aluminum-based alloys, the total reduction or the ratio of the original ingot cross section to the finished product cross section may be as high as 50 to 1. Traditional metal forming operations are also characterized by high stresses and large applied forces which frequently result in significant non-homogeneity of the work piece. As a result, it is often necessary to use powerful and complex machines, which are quite expensive, to produce a satisfactory finished product.

Traditional extrusion processes are frequently directed towards changing the initial shape or cross sectional area of the work piece to the desired shape for the finished product. Such extrusion processes have experienced significant limitations in producing large cross sections and bulk products as well as processing many advanced alloys and composite materials. The problems and limitations are particularly apparent, when the desired results are dependent upon the stress-strain history associated with the extrusion process. Traditional deformation processing equipment and methods are also frequently very expensive and experience high scrap rates related to non-uniformities which may develop in the work piece. Previously available deformation processing equipment will often not satisfactorily process products with large cross sections.

Die assemblies have previously been provided for deformation processing of selected materials by extrusion through two or more extrusion channels disposed at an angle relative to each other and having equal cross sectional areas. These previous die assemblies were often unsatisfactory for deformation processing of high strength, brittle materials due to excessive friction forces associated with movement of the material from one channel into a second channel. Temperature differences also often occurred between different portions of the die assemblies and the material being extruded. Attempts have been made to overcome these limitations by using expensive, complex machinery to apply hydrostatic back pressure to brittle and low ductility materials during the extrusion process. The costs associated with such deformation processing equipment and methods have been very high and the results have been less than satisfactory.

SUMMARY OF THE INVENTION

In accordance with the present invention, apparatus and methods are provided which substantially reduce or eliminate problems and disadvantages associated with previous systems and methods for deformation processing of selected materials. The present invention allows the use of intensive simple shear strains to enhance the physico-mechanical characteristics of selected materials such as high strength, brittle alloys and advanced composites, magnetics and others through deformation processing using an extrusion apparatus.

An extrusion apparatus is provided including a die assembly with a first extrusion channel and a second extrusion channel formed at angles relative to each other for deformation processing of selected materials. The first extrusion channel includes two walls disposed opposite from each other and movable along the longitudinal axis of the first extrusion channel in the direction of extrusion. The moveable walls substantially reduce the negative effects of friction upon a billet or work piece as it moves through the first extrusion channel. A bottom plate assembly is provided within the die assembly to define a portion of the second extrusion channel which communicates with the first extrusion channel. The bottom plate assembly is used to both minimize friction during movement of the billet through the second extrusion channel and to apply a desired back pressure on the billet. The bottom plate assembly includes a first portion which is fixed relative to the die assembly and a second portion which may slide relative to the first portion during movement of the billet through the second extrusion channel.

An important technical advantage of the present invention is that the deformation processing of the selected material is uniform throughout the entire cross section of the respective billet or work piece. By providing substantially reduced friction within the first and second extrusion channels, the present invention produces the same strain at the surface and at the center of the work piece. The only deformation which occurs is a simple shear along the transition plane from the first extrusion channel to the second extrusion channel. The present invention may be used for deformation processing of work pieces with very small cross sections (one-half inch or less) or very large cross sections (ten inches or greater). Also, it is very important that intensive deformation is realized without any change of the original billet cross-section.

Another important technical advantage of the present invention is that the work piece or billet may be passed through the extrusion apparatus several times. The number of extrusions and the orientation of the work piece during each extrusion may be varied to produce the desired properties in the resulting finished product. Brittle materials and difficult-to-deform alloys may be processed to improve their characteristics without requiring high temperature equipment and procedures associated with "isothermal" working of such materials.

A still further technical advantage of the present invention results from minimizing friction forces between the billet and the die assembly as the billet is extruded. Minimizing friction forces ensures uniform deformation of the billet and uniform strain throughout the full cross section of the billet. The present invention minimizes dead zones within the first and second extrusion channels as compared to traditional extrusion processes which produce homogeneous properties in the finished product.

In accordance with one aspect of the present invention, an extrusion apparatus is provided which allows deformation processing of brittle materials such as special metals and alloys, intermetalics, ceramics, high strength plastics, and others without causing defects or damage to the associated work piece. The extrusion assembly significantly minimizes and/or eliminates friction forces which might cause surface cracking defects during extrusion of such brittle materials. Also, the extrusion apparatus allows adjustment of the back pressure on the work piece during the extrusion process to further minimize or eliminate any defects which might be created in brittle materials during deformation processing. The present invention is particularly applicable for deformation processing of super alloys, high strength aluminum and titanium alloys, refractory metals, titanium aluminides, and other inter-metallic materials which are very brittle. For example, deformation processing in accordance with the present invention may be used to improve the room temperature ductility of titanium-aluminum intermetalic from approximately 0.005% to 5% or an improvement of over 100 fold in ductility.

An important technical advantage of the present invention is the achievement of intensive, uniform deformation in billets formed from advanced materials such as high strength and difficult-to-deform alloys. The deformation processing may be used with small billets or massive billets and results in a finished product with the desired characteristics.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is an isometric drawing in elevation and in section with portions broken away of an extrusion apparatus and die assembly incorporating the present invention;

FIG. 2 is a plan view of the extrusion apparatus and die assembly of FIG. 1;

DETAILED DESCRIPTION OF THE INVENTION

Figure 3:
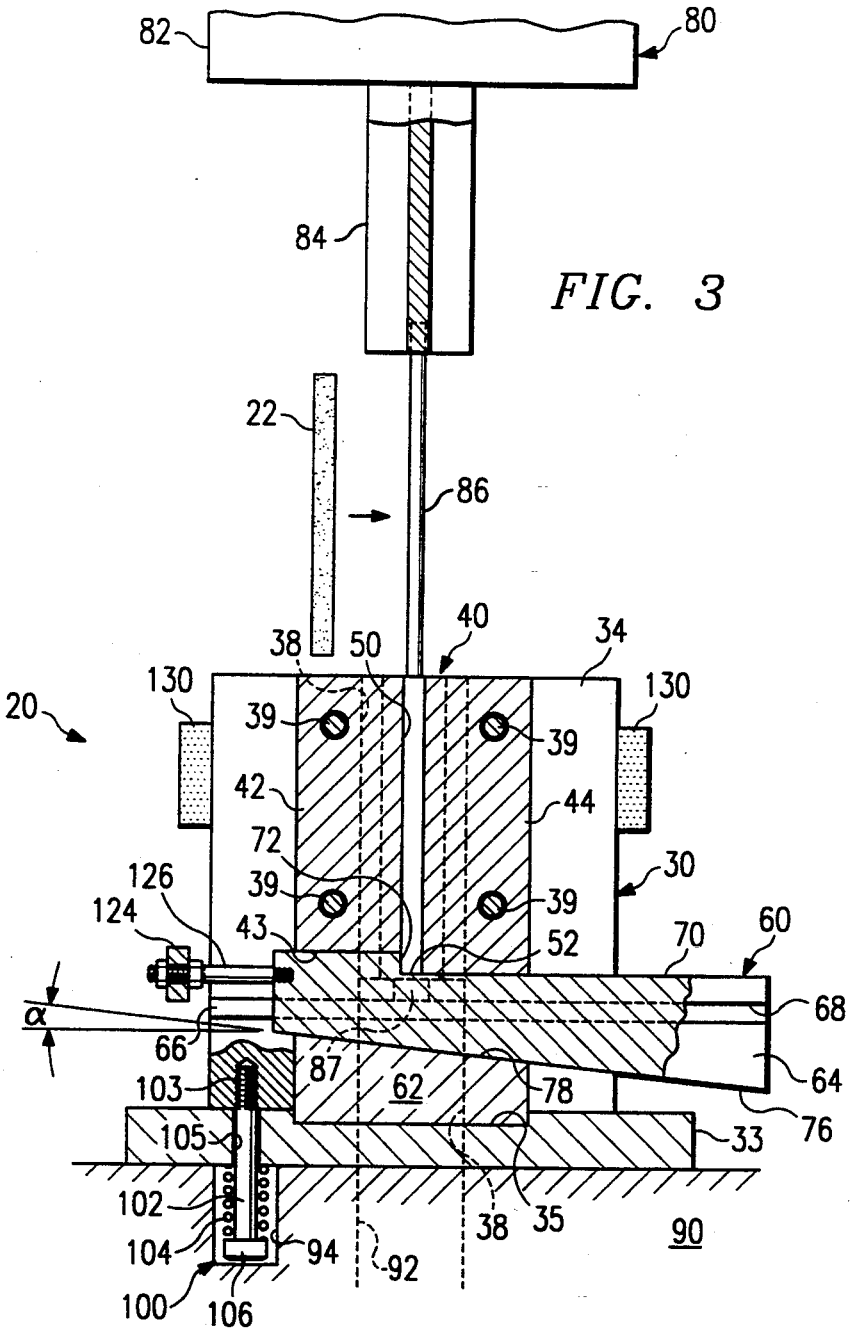
FIG. 3 is a drawing in section and in elevation with portion broken away showing the extrusion apparatus and die assembly of FIG. 1 and an associated punch press assembly incorporating the present invention.

The preferred embodiments of the present invention and its advantages are best understood by referring to FIGS. 1 through 4*c* of the drawings, like numerals being used for like and corresponding parts of the various drawings.

Extrusion apparatus 20 as shown in FIGS. 1 through 4*c* includes die assembly 30, punch press or die press assembly 80 and other components and sub-assemblies which will be described later in more detail. Die assembly 30 includes first extrusion channel 50 and second extrusion channel 52. Die assembly 30 and first extrusion channel 50 are shown with a generally vertical orientation relative to punch press assembly 80. Second extrusion channel 52 is shown with a generally horizontal orientation relative to punch press assembly 80. If desired, die assembly 30 and punch press assembly 80 may be changed from the generally vertical orientation shown in FIGS. 1 through 4*c* to a horizontal orientation or any other orientation which provided the optimum performance for deformation processing of selected materials through first extrusion channel 50 and second extrusion channel 52. For purposes of describing the embodiment shown in FIGS. 1 through 4*c*, reference may be made to "upper", "lower", or "bottom" for ease of description only. The various assemblies, subassemblies and components which comprise extrusion apparatus 20 may be oriented in any manner as desired to provide optimum performance of the associated deformation process.

The principal components of die assembly 30 include die body 32 having a first die body half 34 and a second die body half 36 with die cavity 38 formed therebetween. Die insert assembly 40 is secured between die body halves 34 and 36 by a plurality of bolts 39. For the specific embodiment of the present invention shown in FIGS. 1 through 4*c*, four bolts 39 are used to secure die insert assembly 40 within die body halves 34 and 36. The number of bolts 39 may be varied as desired for alternative embodiments of the present invention. Also, bolts 39 may be replaced with pins or other suitable fasteners for installing die insert assembly 40 between die body halves 34 and 36. Die insert assembly 40 includes several components such as fixed plates 42 and 44, moveable or slidable plates or walls 46 and 48 and bottom plate assembly 60. Plates 42, 44, 46 and 48 cooperate with each other to partially define first extrusion channel 50.

Second extrusion channel 52 is defined in part by end 43 of fixed plate 42, bottom plate assembly 60 and the interior surfaces of plates 46, 48 and die body halves 34 and 36 adjacent thereto. The dimensions of first extrusion channel 50 and second extrusion channel 52 are determined in part by the thickness of plates 42, 44 and bottom plate assembly 60. Each of these components are preferably selected to have the same thickness which results in first extrusion channel 50 and second extrusion channel 52 having equal and uniform cross-sectional areas. This use of equal, uniform cross-sectional areas for both extrusion channels 50 and 52 results in a substantial improvement of the deformation process.

Extrusion channels 50 and 52 are shown with a square cross sectional area which is compatible with the cross sectional area of billet 22. Extrusion channels 50 and 52 may be modified to have other rectangular cross sectional areas as desired for each work piece or billet which will be subject to deformation processing. Die insert assembly 40 may be modified to accommodate billets having cross sections other than square or rectangular.

Punch press or die press assembly 80 preferably includes punch press 82, punch 84 and punch press bed 90. Punch 84 may be extended from punch press 82 towards punch press bed 90 by hydraulic cylinders (not shown) or other suitable means such as rack and pinion gears (not shown) of any press or other metal working equipment. The dimensions and stroke of punch 84 are selected to allow insertion of punch 84 into die cavity 38 to force billet 22 to move through extrusion channels 50 and 52. Punch press assembly 80 will preferably include hydraulic pumps, cylinders and associated piping systems (not shown). Also, various electronic and/or pneumatic control systems (not shown) may be used to operate punch press assembly 80 and extrusion apparatus 20.

Die assembly 30 includes die body 32 secured to and resting on die block holder 33. Die block holder 33 is preferably secured to and rests upon punch press bed 90. Punch press bed 90 preferably includes an enlarged opening 92 which is aligned with and communicates with die cavity 38 when die assembly 30 is secured to punch press bed 90. Punch 84 is preferably connected to moveable plates 46 and 48 by a pair of rods or drafts 86 and 88 respectively. Drafts 86 and 88 extend longitudinally through their respective moveable plate 46 and 48 as shown in FIGS. 2, 4*a* and 4*c*.

Rods 86 and 88 are substantially longer than their respective moveable plates 46 and 48. Therefore, when punch 84 is fully withdrawn from die assembly 30 as shown in FIG. 3, an opening is provided to allow placing billet 22 into first extrusion channel 50. As punch press assembly 80 inserts punch 84 into die cavity 38, rods 86 and 88 move longitudinally into opening 92 of punch press bed 90. As shown in FIG. 4*c* and will be explained later in more detail, longitudinal movement of punch 84 within die cavity 38 results in longitudinal movement of moveable walls 46 and 48 through die cavity 38 and opening 92 in punch press bed 90. An enlarged head 87 is provided on the end of rod 86 to assist with positioning moveable wall 46 with punch 84. A similar head (not shown) is provided on the end of rod 88.

Figure 4B:
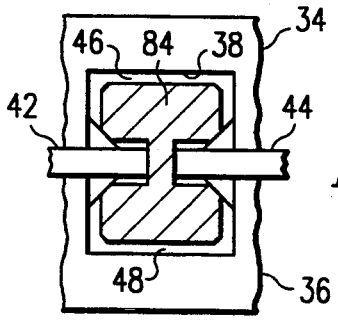
FIG. 4*b* is a drawing in section with portion broken away taken along lines 4*b* –4*b* of FIG. 4*a* showing a punch inserted into the die assembly for extrusion of the billet.
Figure 4C:
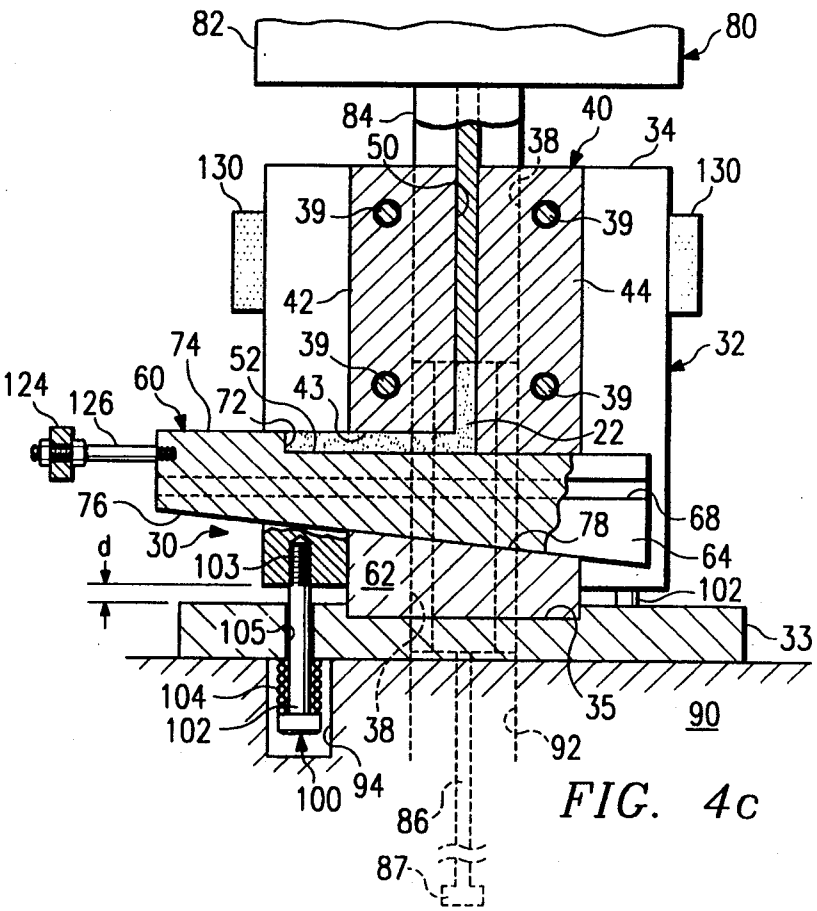
FIG. 4*c* is a drawing in section and in elevation with portions broken away showing the extrusion apparatus, die assembly and punch press assembly of FIG. 3 with the billet in an intermediate position during uniform deformation processing by extrusion through the die assembly.
Figure 4A:
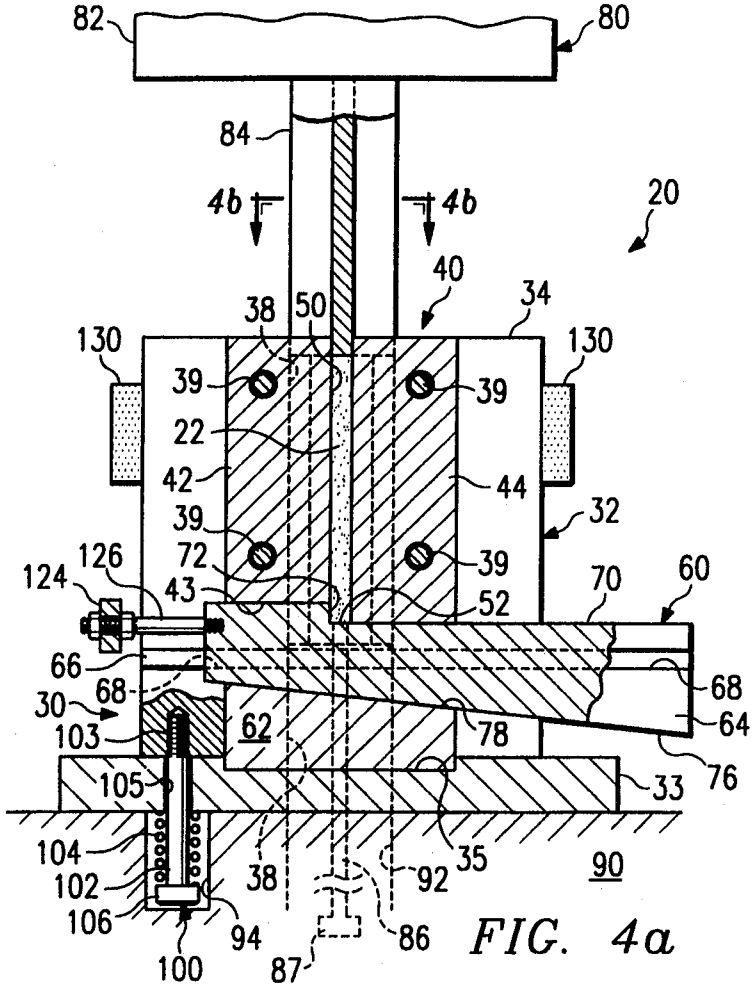
FIG. 4*a* is a drawing in section and in elevation with portions broken away showing a billet initially disposed in the extrusion apparatus, die assembly and punch press assembly of FIG. 3 prior to deformation processing of the billet.

Bottom plate assembly 60 preferably includes first portion 62 which is secured to die block holder 33 as shown in FIGS. 3, 4*a* and 4*c*. For ease of manufacture and assembly, first portion 62 is disposed within recess 35 formed in die block holder 33. Other means such as screws, bolts and/or brackets (not shown) may be used to secure first portion 62 to die block holder 33 in addition to or as an alternative to recess 35. Second portion 64 of bottom plate assembly 60 is slidably disposed on first portion 62 and extends longitudinally between die body halves 34 and 36. An important feature of the present invention results from second portion 64 of bottom plate assembly 60 being slidably disposed between die body halves 34 and 36 to partially define second extrusion channel 52.

Two sets of slidable tongue and groove connections are preferably provided on opposite sides of second portion 64 and the adjacent surfaces of die body halves 34 and 36. As shown in FIGS. 1, 3 and 4*a*, tongue 66 is formed on the interior of die body half 34. Tongue 66 preferably extends across die body half 34 below first extrusion channel 50 and parallel with die block holder 33 providing space for movement of plate 46. A matching groove 68 is formed on the adjacent surface of second portion 64. A similar tongue (not shown) is provided on the interior of die body half 36 for engagement with the adjacent groove 68. Two sets of slidable tongue and groove connections 66 and 68 are provided to maintain alignment of second portion 64 during reciprocating movement between die body halves 34 and 36.

Second portion 64 of bottom plate assembly 60 preferably includes upper surface or upper edge 70 and protrusion 72 which partially define second extrusion channel 52. Surface 74 extends from protrusion 72 to complete the upper edge of second portion 64. Second portion 64 of bottom plate assembly 60 preferably includes lower surface or lower edge 76 disposed adjacent to and resting upon a matching surface 78 provided by first portion 62 of bottom plate assembly 60.

As will be explained later in more detail, lower surface 76 of second portion 64 and adjacent surface 78 of first portion 62 are preferably disposed at an angle ($\alpha$) relative to die block holder 33 and punch press bed 90. Protrusion 72 and angle ($\alpha$) formed by adjacent surfaces 76 and 78 cooperate with each other to determine the amount of back pressure applied to billet 22 as it moves through first extrusion channel 50 and second extrusion channel 52.

A plurality of brackets 118 are provided on opposite sides of die body 32 to mount a pair of hydraulic cylinders 120 on opposite sides of die body 32. Each hydraulic cylinder 120 includes an associated ram 122 extending therefrom and attached to cross-connect bar 124. Rod 126 is disposed intermediate of the ends of cross-connect bar 124 and is attached to second portion 64 of bottom plate assembly 60. Hydraulic cylinders 120 and their associated rams 122 may be used to reposition second portion 64 of bottom plate assembly 60 following extrusion of billet 22 through first channel 50 and second extrusion channel 52. In addition to repositioning second portion 64, hydraulic cylinders 120 and their associated rams may be used to enhance or supplement the back pressure developed by protrusion 72 and angle ($\alpha$) during movement of billet 22 through second extrusion channel 52.

Second extrusion channel 52 is shown formed at an angle of 90 degrees relative to first extrusion channel 50. If desired, second portion 64 of bottom plate assembly 60 and end 43 of fixed plate 42 may be modified such that second extrusion channel 52 extends from first extrusion channel 50 at an angle other than 90 degrees. An important feature of the present invention is that bottom plate assembly 60 may be easily modified to provide the desired amount of back pressure on billet 22 as it moves through second extrusion channel 52 and together with plates 42, 44 also vary the angular relationship of second extrusion channel 52 with respect to first extrusion channel 50.

A plurality of fastener assemblies 100 as shown in FIGS. 2, 3, 4*a* and 4*c*, are provided for securing die block 32 to die body holder 33. As shown in FIG. 4*c*, fastener assemblies 100 provide means for allowing movement of die body 32 relative to die block holder 33 during extrusion of billet 22. Four fastener assemblies 100 may be included as part of die assembly 30 as shown in FIG. 2*c*. Additional fastener assemblies 100 may be included as desired.

Each fastener assembly 100 includes bolt 102 which is attached respectively to either die body half 34 and 36 by threaded connections 103. Each bolt 102 is disposed in its respective opening 105 which extends through die block holder 33. An enlarged head 106 is formed on the end of each bolt 102 extending from die block holder 33 and opposite from threaded connection 103. Spring 104 is disposed on the exterior of each bolt 102 between die block holder 33 and enlarged head 106. Alternative embodiments of extrusion apparatus 20 include adding hydraulic cylinders and/or bellows to replace springs 104.

A plurality of recesses 94 are formed in punch press bed 90. A portion of each fastener assembly 100 is disposed within its associated recess 94. As punch 84 is inserted into die cavity 38 and billet 22 is extruded from first extrusion channel 50 into second extrusion channel 52, fastener assemblies 100 allow die body 32 to move upwardly relative to die block holder 33. The amount of movement is shown as distance (d) in FIG. 4*c*. The amount of movement (d) is proportional to tangent of angle ($\alpha$) and the length of the longitudinal movement of second portion 64 of bottom plate assembly 60.

As shown in FIGS. 3, 4*a* and 4*c*, heater assembly 130 may be attached to die body 32 to adjust the temperature of the various components associated with die assembly 30 and particularly the components which comprise die insert assembly 40. The use of heater assembly 130 and the specific temperature will be dependent upon the type of material which will be extruded through first extrusion channel 50 and second extrusion channel 52. For many materials, extrusion apparatus 20 will perform satisfactorily without the addition of heater assembly 130.

Extrusion apparatus 20 may be used for deformation processing of billet 22 to enhance the mechanical and physical characteristics of different materials from which billet 22 has been formed.

The selected material is preferably formed into the shape of a billet or work piece which is sized to be received within first extrusion channel 50 as shown in FIG. 2. Punch press assembly 80 may then be used to insert punch 84 into die cavity 38 until the end of punch press assembly 84 contacts the top of moveable plates 46 and 48 as shown in FIGS. 4*a* and 4*b*. Punch 84 has a generally H-shaped cross section for the specific embodiment of the present invention shown in FIGS. 1 through 4*c*. The cross section of punch 84 may be varied to correspond with the cross section of die cavity 38 and first extrusion channel 50.

As punch press assembly 80 applies force to billet 22 and moveable walls 46 and 48, billet 22 will be extruded from first extrusion channel 50 into second extrusion channel 52. At the transition plane between first extrusion channel 50 and second extrusion channel 52, the selected material will be subjected to simple shear deformation. This deformation of billet 22 results in alteration of the microstructure and texture of the associated materials. Such plastic deformation may be used to enhance selected material characteristics such as ductility, strength, or toughness. Billet 22 may be subjected to repeated extrusions through apparatus 20 until the desired characteristics have been obtained.

An important feature of the present invention is the uniform deformation of billet 22 throughout its entire cross section at the transition plane between first extrusion channel 50 and second extrusion channel 52. This uniform deformation is assisted by reducing or substantially eliminating friction forces associated with the movement of billet 22 through first extrusion channel 50 and second extrusion channel 52.

Friction forces are reduced by allowing moveable walls 46 and 48 to slide longitudinally within die cavity 38 as punch 84 forces billet 22 from first extrusion channel 50 into second extrusion channel 52. Friction forces are further reduced by second portion 64 of bottom plate assembly 60 moving longitudinally with billet 22 as punch 84 forces billet 22 from first extrusion channel 50 into second extrusion channel 52.

As billet 22 moves into second extrusion channel 52, it contacts protrusion 72 and forces second portion 64 to move longitudinally at the same speed as billet 22 moves within second extrusion channel 52. Moveable walls 46 and 48 also move vertically in unison with billet 22 as it travels through first extrusion channel 50. Billet 22 moveable walls 46, 48 and second portion 64 of bottom plate assembly 60 are preferably lubricated with graphite or other lubricants to further reduce the friction forces associated with the movement of billet 22 from first extrusion channel 50 into second extrusion channel 52.

Another important feature of the present invention results from bottom plate assembly 60 applying a desired amount of back pressure on billet 22 during movement from first extrusion channel 50 into second extrusion channel 52. By using bottom assembly 60 to provide the desired amount of back pressure, brittle materials, may be subjected to deformation processing without damaging the associated billet or work piece.

The amount of back pressure is dependent upon the friction forces generated between lower surface 76 of second portion 64 and upper surface 78 of first portion 62 of bottom plate assembly 60 as well as angle ($\alpha$) and the amount of force which is applied to billet 22 and thus protrusion 72 by punch 84. As increased force is applied to billet 22 to cause plastic deformation associated with simple shear during movement of billet 22 from first extrusion channel 50 into second extrusion channel 52, the back pressure generated by second portion 64 of bottom plate assembly 60 will also increase.

The amount of back pressure may be adjusted by varying coefficient of friction between surfaces 76 and 78, angle ($\alpha$) and/or the angle at which first extrusion channel 50 intersects with second extrusion channel 52. The present invention allows generating the appropriate amount of back pressure for selected materials without requiring the addition of expensive hydraulic and/or mechanical components to restrict the movement of bottom plate assembly 60. As previously noted a pair of hydraulic cylinders 120 may be provided to reposition second portion 64 of bottom plate assembly 60 following completion of the extrusion process. However, the working capacity of hydraulic cylinders 120 would have to be substantially increased if hydraulic cylinders 120 were used to maintain the back pressure on billet 22 without the benefit of the friction forces generated by second portion 64 moving relative to first portion 62 of bottom plate assembly 60.

Punch press assembly 80 and punch 84 provide the necessary force to move or extrude billet 22 from first extrusion channel 50 into second extrusion channel 52. This force must be sufficient enough to overcome the resistance to movement of billet 22 generated by the counter-pressure (P) applied to the end of billet 22 by protrusion 72. The counter-pressure (P) is transmitted to the shear plane generated in billet 22 in the form of hydrostatic pressure which is super-imposed upon the forces associated with plastic deformation of billet 22 at the shear plane during transition from first extrusion channel 50 into second extrusion channel 52.

An analysis shows that for the case of the perpendicular channels, the counter-pressure (P) is mainly dependent on the normal (N) and tangent ($\mu$N) forces applied to second portion 64 of bottom plate assembly 60 in accordance with the equation:

$$\frac{P}{\sigma_s} = \frac{\sin\alpha + \mu\cos\alpha}{\cos\alpha - \sin\alpha - \mu(\sin\alpha + \cos\alpha)} \quad (1)$$

where $\sigma_s$—flow stress of the material, forming billet 22

$\mu$—coefficient of friction between surfaces 76 and 78, and $\alpha$—angle between first portion 62 and second portion 64 of bottom plate assembly 60.

Because the quantities $\alpha$ and $\mu$ are constant, the ratio $P/\sigma^s$ is the same for different materials. This ratio can be modified by changing angle $\alpha$ and/or the coefficient of friction $\mu$.

Preferably, hydrostatic pressure should not exceed the material flow stress $\sigma_s$ associated with billet 22 to prevent upsetting of billet 22 in second extrusion channel 52. Because friction is always present between first portion 62 and second portion 64 ($\mu>0$), angle $\alpha$ may be changed within a range of $$0<\alpha<26°. \quad (2)$$

For example, to develop the hydrostatic pressure that usually is necessary for successful deformation processing of difficult-to-deform material such as titanium aluminide back pressure should be about one-half of flow stress ($P\sim\sigma_s/2$), and for a typical friction coefficient ($\mu$) for steel of 0.15, angle $\alpha$ is approximately 10°.

In some cases first portion 62 and second portion 64 of bottom plate assembly 60 may be formed with angle $\alpha$ equal to zero. For this case, the counter-pressure (P) is:

$$\frac{P}{\sigma_s} = \frac{\mu}{1-\mu} \quad (3)$$

When the lower end of punch 84 reaches the top surface of second extrusion channel 52, punch 84 will move upward and return movable plates 46 and 48 to their initial position. Hydraulic cylinders 120 and cross-connect bar 124 may be used to further move second portion 64 of bottom plate assembly 60 longitudinally to allow removal of billet 22 from second extrusion channel 52. After billet 22 has been removed, hydraulic cylinders 120 and their associated rams 122 may be used to reposition second portion 64 of bottom plate assembly for another extrusion of billet 22.

Although the present invention and its advantages have been described in detail, it should be understood that various changes, substitutions and alterations can be made therein without departing from the spirit and scope of the invention as defined by the following claims.

What is claimed is:

1. An extrusion apparatus for deformation processing of selected materials comprising:

a die assembly having a first extrusion channel and a second extrusion channel disposed therein;

a punch press assembly associated with the die assembly to force the selected materials to move through the first and second extrusion channels;

the first extrusion channel and the second extrusion channel having equal cross-sectional areas with the second extrusion channel disposed at an angle relative to the first extrusion channel;

the second extrusion channel defined in part by a bottom plate assembly which may move relative to the die assembly during extrusion of the selected materials through the die assembly; and the first extrusion channel further comprising a first pair of plates disposed opposite from each other and secured to the die assembly and a second pair of plates which are slidable disposed opposite from each other within the die assembly.

2. The extrusion apparatus as defined in claim 1 wherein the punch press assembly further comprises:

a punch press bed with the die assembly secured thereto; and a punch which may be inserted into the die assembly to force extrusion of the selected materials through the first extrusion channel and the second extrusion channel.

3. The extrusion apparatus as defined in claim 2 wherein the die assembly further comprises:

a die block holder secured to the punch press bed; and the bottom plate assembly having a first portion secured to the die block holder and a second portion slidable disposed relative to the first portion.

4. The extrusion apparatus as defined in claim 1 wherein the second extrusion channel is disposed at an angle of approximately 90 degrees relative to the first extrusion channel.

5. The extrusion apparatus as defined in claim 1 further comprising a heater assembly secured to the exterior of the die assembly.

6. The extrusion apparatus as defined in claim 1 further comprising:

the die assembly having a die body secured to a die block holder;

the punch press assembly having a punch press bed with the die block holder secured thereto;

the punch press assembly having a punch for insertion into the die assembly to force movement of the selected materials through the first extrusion channel and the second extrusion channel; and means for allowing movement of the die body relative to the die block holder during extrusion of the selected materials through the first extrusion channel and the second extrusion channel by the punch press assembly.

7. The extrusion apparatus as defined in claim 6 further comprising:

the die body having a first die half and a second die half with a die cavity formed therebetween;

a first pair of plates disposed opposite from each other and secured between the first die half and the second die half of the die body;

a second pair of plates slidably disposed opposite from each other within the die cavity; and the first pair of plates and the second pair of plates cooperating to partially define the first extrusion channel within the die cavity.

8. An extrusion apparatus for deformation processing of selected materials comprising:

a die assembly having a first extrusion channel and a second extrusion channel disposed therein:

a punch press assembly associated with the die assembly to force the selected materials to move through the first and second extrusion channels;

the first extrusion channel and the second extrusion channel having equal cross-sectional areas with the second extrusion channel disposed at an angle relative to the first extrusion channel;

the second extrusion channel defined in part by a bottom plate assembly which may move relative to the die assembly during extrusion of the selected materials through the die assembly;

a punch press bed with the die assembly secured thereto;

a punch which may be inserted into the die assembly to force extrusion of the selected materials through the first extrusion channel and the second extrusion channel;

a die block holder secured to the punch press bed;

the bottom plate assembly having a first portion secured to the die block holder and a second portion slidable disposed relative to the first portion;

an upper surface which partially defines the second extrusion channel; and a lower surface disposed at an angle $\alpha$ relative to the first portion of the bottom plate assembly.

9. An extrusion apparatus for deformation processing of selected materials comprising:

a die assembly having a first extrusion channel and a second extrusion channel disposed therein;

a punch press assembly associated with the die assembly to force the selected materials to move through the first and second extrusion channels;

the first extrusion channel and the second extrusion channel having equal cross-sectional areas with the second extrusion channel disposed at an angle relative to the first extrusion channel;

the second extrusion channel defined in part by a bottom plate assembly which may move relative to the die assembly during extrusion of the selected materials through the die assembly;

a punch press bed with the die assembly secured thereto;

a punch which may be inserted into the die assembly to force extrusion of the selected materials through the first extrusion channel and the second extrusion channel;

a die block holder secured to the punch press bed;

the bottom plate assembly having a first portion secured to the die block holder and a second portion slidable disposed relative to the first portion;

a hydraulic cylinder with an associated ram extending therefrom;

the hydraulic cylinder secured to the die assembly; and the ram connected with the second portion of the bottom plate assembly whereby the hydraulic cylinder and ram may be used to reposition the second portion of the bottom plate assembly following extrusion of the selected materials.

10. The method of deformation processing of selected material using an extrusion apparatus having a first extrusion channel and a second extrusion channel disposed at a first angle relative to each other and having equal cross section areas comprising the steps of:

placing the selected material in the first extrusion channel;

applying force to the selected material with a punch press to force the material from the first extrusion channel into the second extrusion channel;

applying a back pressure to the selected material to limit movement through the second extrusion channel;

forming the second extrusion channel with a bottom plate assembly having a first, fixed portion and a second, slidable portion;

Securing the first, fixed portion of the bottom plate assembly to the extrusion apparatus to prevent movement of the first portion with respect thereto; and forming a second angle between the first portion of the bottom plate assembly and the second portion of the bottom plate assembly adjacent thereto.

11. The method of deformation processing of selected material as defined in claim 10 further comprising the step of varying the second angle between the first portion of the bottom plate assembly and the second portion of the bottom plate assembly based on the desired amount of back pressure which will be applied to the selected material during movement through the first extrusion channel and the second extrusion channel.

12. The method of deformation processing of selected material as defined in claim 10 further comprising the steps of:

forming a die assembly from a first die body half and a second die body half with a die cavity disposed therebetween:

securing a pair of fixed plates between the die body halves and spaced opposite from each other to partially define the first extrusion channel within the die cavity; and disposing a pair of slidable plates within the die cavity opposite from each other to further partially define the first extrusion channel.

13. The method of deformation processing of selected material as defined in claim 10 further comprising the steps of:

installing a bottom plate assembly between a first die body half and a second die body half to partially defined the second extrusion channel; and limiting movement of the bottom plate assembly to create the desired back pressure on the selected material.

14. The method of deformation processing of selected material as defined in claim 10 further comprising the steps of:

forming the selected material in a billet having a cross section corresponding with the cross section of the first extrusion channel and the second extrusion channel;

forcing the billet to move through the first extrusion channel and the second extrusion channel with a die punch assembly; and repeating the steps until the selected material has the desired physical properties.

15. The method of deformation processing of selected material as defined in claim 10 further comprising the steps of forming the first extrusion channel and the second extrusion channel in a die assembly; and heating the die assembly to a selected temperature based on the desired physical properties in the selected material following deformation processing with the extrusion apparatus.

16. The method of deformation processing of selected material as defined in claim 10 further comprising the step of forming the second extrusion channel with the first angle extending approximately 90° relative to the first extrusion channel.

17. The method of deformation processing of selected material as defined in claim 11 further comprising the step of varying the angle between the second extrusion channel and the first extrusion channel based upon the desired characteristics of the selected material following deformation processing with the extrusion apparatus.

18. An extrusion apparatus for deformation processing of selected materials comprising:

a die assembly having a first extrusion channel and a second extrusion channel disposed therein;

a punch press assembly associated with the die assembly to force the selected materials to move through the first and second extrusion channels;

the first extrusion channel and the second extrusion channel having equal cross-sectional areas with the second extrusion channel disposed at an angle relative to the first extrusion channel;

the first extrusion channel defined in part by a first pair of plates disposed opposite from each other and secured to the die assembly;

a second pair of plates which are slidable disposed opposite from each other within the die assembly;

a die block holder secured to the punch press bed;

a bottom plate assembly having a first portion secured to the die block holder and a second portion slidable disposed relative to the first portion;

an upper surface which partially defines the second extrusion channel; and a lower surface disposed at an angle ($\alpha$) relative to the first portion of the floor.

19. The extrusion apparatus as defined in claim 18 wherein the second extrusion channel further comprises a bottom plate assembly which may move relative to the die assembly during extrusion of the selected materials therethrough.

20. The extrusion apparatus as defined in claim 18 wherein the punch press assembly further comprises:

a punch press bed with the die assembly secured thereto; and a punch which may be inserted into the die assembly to force extrusion of the selected materials through the first extrusion channel and the second extrusion channel.

21. The extrusion apparatus as defined in claim 18 further comprising:

a hydraulic cylinder with an associated ram extending therefrom;

the hydraulic cylinder secured to the die assembly; and the ram connected with the second portion of the bottom plate assembly whereby the hydraulic cylinder and ram may be used to reposition second portion of the bottom plate assembly following extrusion of the selected materials.

22. The extrusion apparatus as defined in claim 18 wherein the second extrusion channel is disposed at an angle of approximately 90 degrees relative to the first extrusion channel.

23. The extrusion apparatus as defined in claim 18 further comprising a heater assembly secured to the exterior of the die assembly.

24. The extrusion apparatus as defined in claim 18 further comprising:

the die assembly having a die body secured to a die block holder;

the punch press assembly having a punch press bed with the die block holder secured thereto;

the punch press assembly having a punch for insertion into the die assembly to force movement of the selected materials through the first extrusion channel and the second extrusion channel; and means for allowing movement of the die body relative to the die block holder during extrusion of the selected materials through the first extrusion channel and the second extrusion channel by the punch press assembly.

25. The extrusion apparatus as defined in claim 24 further comprising:

the die body having a first die half and a second die half with a die cavity formed therebetween;

the first pair of plates disposed opposite from each other and secured between the first die half and the second die half of the die body;

the second pair of plates slidable disposed opposite from each other within the die cavity; and the first pair of plates and the second pair of plates cooperating to partially define the first extrusion channel within the die cavity.

26. An extrusion apparatus for deformation processing of a selected material comprising:

a die assembly having a die body and a die block holder;

the die body including a first die half and a second die half with a die cavity formed therebetween;

a first pair of plates disposed opposite from each other and secured between the first die half and the second die half of the die body;

a second pair of plates slidable disposed opposite from each other within the die cavity;

the first pair of plates and the second pair of plates cooperating with each other to partially define a first extrusion channel within the die cavity;

a bottom plate assembly disposed between the first die body half and the second die body half to partially define a second extrusion channel formed in the die assembly at an angle relative to the first extrusion channel;

the bottom plate assembly having a first portion secured to the die block holder and a second portion slidable disposed relative to the first portion whereby the second portion of the bottom plate assembly may move with the selected material during extrusion through the second extrusion channel;

the second portion of the bottom plate assembly having an upper edge which partially defines the second extrusion channel and a bottom edge which rests upon the first portion of the bottom plate assembly;

the bottom edge of the second portion and the adjacent edge of the first portion formed at an angle $\alpha$ relative to each other; and a protrusion from the upper edge of the second portion of the bottom plate assembly whereby the protrusion and the angle $\alpha$ cooperate with each other to induce a back pressure on the selected material during extrusion through the second extrusion channel.

27. The extrusion apparatus for deformation processing of selected material as defined in claim 26 further comprising a heater assembly secured to the exterior of the die block assembly.

28. The extrusion apparatus or deformation processing of selected material as defined in claim 26 further comprising a hydraulic cylinder operably connected to the second portion of the bottom plate assembly to further control the application of back pressure to the selected material during extrusion through the second extrusion channel.

29. The extrusion apparatus for deformation processing of selected material as defined in claim 26 further comprising the second portion of the bottom plate assembly formed at an angle $\alpha$ relative to the first portion of the bottom plate assembly and the angle $\alpha$ having a value equal to or less than 26°.

* * * * *